US005404704A

United States Patent [19]

Menegatto

[11] Patent Number: 5,404,704

[45] Date of Patent: Apr. 11, 1995

[54] SPINDLE DRIVING AND SUPPORTING DEVICE FOR TEXTILE MACHINES

[76] Inventor: Carlo Menegatto, Via Spreafico No 3, 20052 Monza, Milano, Italy

[21] Appl. No.: 62,982

[22] Filed: May 18, 1993

[30] Foreign Application Priority Data

May 18, 1992 [IT] Italy ..... MI92A1187

[51] Int. Cl.[6] ..... D01H 13/00; D01H 7/86

[52] U.S. Cl. ..... 57/100; 310/89; 310/91

[58] Field of Search ..... 57/100; 310/89, 91

[56] References Cited

U.S. PATENT DOCUMENTS

| | | | |
|---|---|---|---|
| 3,095,687 | 7/1963 | Beerli | 57/100 X |
| 3,378,998 | 4/1968 | Shackelford | 57/56 |
| 3,977,169 | 8/1976 | Suzuki et al. | 57/1 R |
| 4,348,860 | 9/1982 | Hartmannsgruber | 57/100 |
| 4,731,985 | 3/1988 | Menegatto | 57/135 |
| 4,904,892 | 2/1990 | Hildbrand et al. | 310/91 X |
| 4,908,534 | 3/1990 | Gobler et al. | 310/91 X |
| 5,061,867 | 10/1991 | Seiffert et al. | 310/91 X |
| 5,111,647 | 5/1992 | Gabalda | 57/100 |
| 5,161,361 | 11/1992 | Talley et al. | 57/100 X |

FOREIGN PATENT DOCUMENTS

| | | | |
|---|---|---|---|
| 0395541 | 10/1990 | European Pat. Off. . | |
| 1930207 | 12/1970 | Germany . | |
| 150756 | 11/1980 | Japan | 310/89 |
| 4361624 | 12/1992 | Japan . | |

*Primary Examiner*—Daniel P. Stodola
*Assistant Examiner*—William Stryjewski
*Attorney, Agent, or Firm*—Young & Thompson

[57] ABSTRACT

A spindle driving device for winding machines and similar textile machines wherein the spindle is supported rotatably by a cartridge held by an elastic system; the spindle is connected to an electric drive motor, whose stator is fastened removably to the spindle cartridge, while the rotor is fastened removably to an extension of the spindle which projects from one end of the support cartridge.

6 Claims, 2 Drawing Sheets

SPINDLE DRIVING AND SUPPORTING DEVICE FOR TEXTILE MACHINES

BACKGROUND OF THE INVENTION

1. Field of the Invention

The present invention relates to a spindle-driving device for winding machines and similar textile machines, in which the spindle is supported rotatably by a cylindrical cartridge held by elastic thrust means acting radially and peripherally around the cartridge itself, between the latter and a fixed support element, and in which the spindle is connected to an electric drive motor.

2. Description of the Related Art

From U.S. Pat. No. 4,731,985, a spindle for textile machines is supported rotatably by a cartridge held radially by elastic thrust means arranged peripherally both to dampen the vibrations to which a textile spindle is normally subjected, and to facilitate application and removal of the spindle itself without having to remove the entire support device.

In general spindles on a textile machine are driven by means of a mechanical transmission formed substantially by a tangential belt which extends for the whole length of the machine and which is pushed, by means of idle rollers, against the corresponding pulleys of the spindles.

The tangential belt drive for a whole assembly of spindles is commonly used on textile machines which work at relatively low speeds. The current tendency to increase spindle rotation speeds considerably to reach 30,000 r.p.m. and over has been found to be impossible with belt drives due to the loud noise generated by the mechanical transmission and the high consumption of energy necessary for driving rotation of the spindles, a consumption which rises progressively and exponentially as the rotation speed of the spindles themselves increases. Moreover, with tangential belt drives, special and complex techniques are required to keep the drive belt away from the pulley of each individual spindle, when the latter has to be stopped for example to repair a broken thread, without having to stop the entire textile machine.

U.S. Pat. No. 4,348,860 introduces the use of electric drive motors for each individual spindle, powered at high frequency to reach the high working speeds required. Nevertheless the constructional solutions proposed hitherto make the application of spindles and their removal for routine maintenance, required by the rotating mechanical parts with a certain frequency, extremely difficult. Moreover the use of an electric motor for each spindle, according to the ideas previously known, is not suitable for application to spindles supported oscillatingly, for example according to the support device shown in U.S. Pat. No. 4,731,985 cited previously. Any relative movement between the rotor and stator of the electric motor could bring the two parts into contact, damaging them irreparably.

SUMMARY AND OBJECTS OF THE INVENTION

The object of the present invention is to provide a motor-driven textile spindle, able to work at high rotation speeds with low noise levels and low energy consumption rates such as to facilitate operations of maintenance, thus avoiding the disadvantages to be found in previous motor-driven spindles.

A further object of the present invention is to provide a motor-driven textile spindle which maintains the advantages of the damping support according to U.S. Pat. No. 4,731,985 and which at the same time allows full interchangeability and independence between spindle and drive motor.

The abovementioned objects are achieved by means of a spindle-driven device having a radially acting vibration-damping support system in which the electric drive motor is connected removably to the spindle itself and to the support cartridge respectively to enable its removal by merely sliding the spindle out of its elastic support whenever this is required after removal of the motor, for example to subject the spindle and/or its component parts or the motor itself to overhauling or normal routine maintenance.

BRIEF DESCRIPTION OF THE DRAWINGS

A preferred embodiment of a motor-driven textile spindle, according to the invention will be illustrated in greater detail hereinunder, with reference to the accompanying drawings, in which.

DETAILED DESCRIPTION OF THE PREFERRED EMBODIMENT

Figure 1:
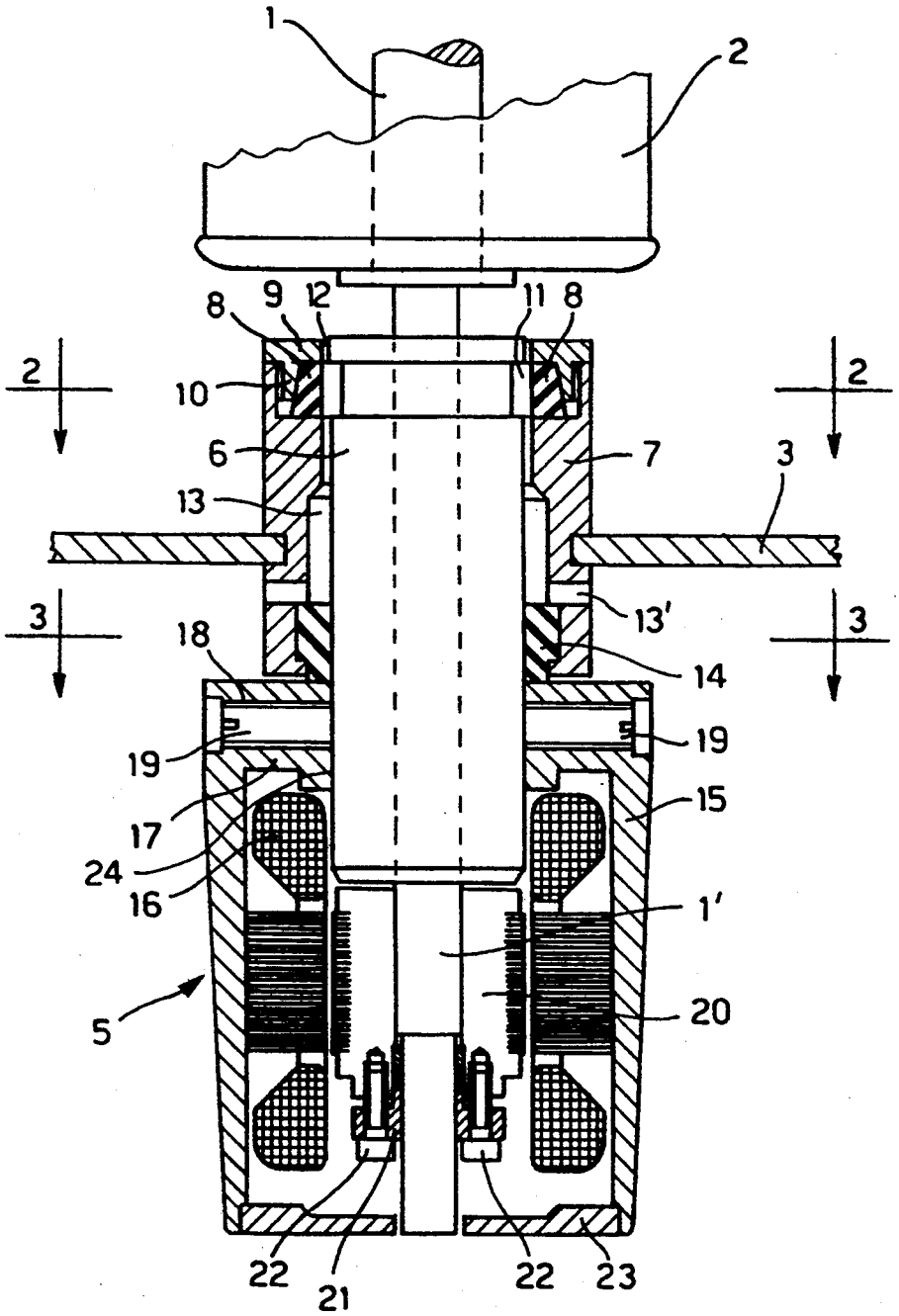
FIG. 1 is a view of a longitudinal section of the lower part of the spindle, with the respective support device and the electric drive motor.

In FIG. 1, a rotating spindle 1 supports a spool of yarn 2; the spindle 1 is appropriately fastened to the frame 3 of a textile machine, partially shown, to be driven to rotate at high speed by means of an electric motor 5 which is arranged in a position beneath the frame 3.

In particular, the spindle 1 is supported rotatably by means of a cylindrical cartridge 6, supported radially by two elastic support systems housed in a hollow body 7 or casing secured to the frame 3.

Figure 2:
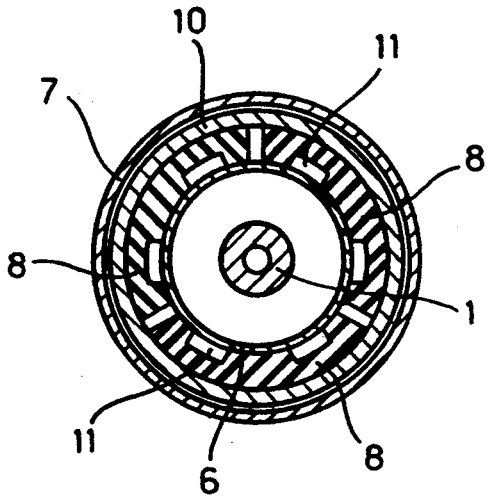
FIG. 2 is a view of a transverse section of the support along line 2—2 of FIG. 1.

More particularly, the upper elastic support system, as shown in FIG. 2, comprises elastic pads 8, in the form of a circular, elastomeric segment, arranged peripherally around the cartridge 6, between the latter and a radial thrust element comprising an upper cover 9, shown only in FIG. 1 and provided below with a conical edge defined internally by a slanted surface 10, shown in both FIGS. 1 and 2, for radially pushing against the similarly slanted surface of the pads 8. The radial compression of the pads 8 against the cartridge 6 is achieved by moving the cover of FIG. 1 axially towards the body 7 by means of suitable tightening screws, not shown, so that the axial movement of the cover 9 causes radial thrust of the pads 8 against the external cylindrical surface of the aforementioned cartridge 6.

Advantageously, the pads 8 of the upper elastic system have a cogged internal surface or with longitudinal recesses 11 which on one side lead to the outside through a circular slot 12, shown only in FIG. 1, between the closure cover 9 and the upper end of the cartridge 6, while on the other side, the longitudinal recesses 11 lead into an annular chamber or internal passage 13, formed between the cartridge 6 and the body 7. The chamber 13 in turn opens outwardly, below the frame 3, through radial holes 13' immediately above the second elastic support system.

Figure 3:
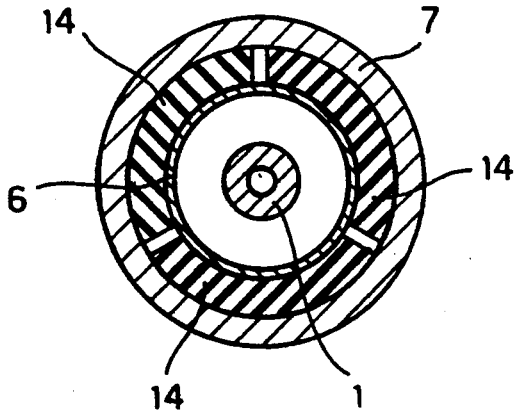
FIG. 3 is a view of a transverse section of the support along line 3—3 of FIG. 1.

The second elastic support system comprises an annular element formed by circular elastomeric segments 14 as shown in FIG. 3, arranged peripherally between the cartridge 6 and the lower end of the body 7. The segments 14 are suitably supported axially by an internal annular shoulder.

As can be seen in FIG. 1, the cartridge 6 which supports the rotary spindle 1 extends axially below the hollow body 7 and, correspondingly, the spindle 1 extends beyond the lower end of the cartridge 6 with a leg, defining the shaft 1' of the electric motor 5.

According to the present invention, the motor 5 is removably fastened to the cartridge 6 and to the shaft 1' of the spindle 1 respectively so as to allow removal of the spindle by merely sliding it out and upwards, after having loosened the radial thrust of the elastic pads. Moreover the entire motor is supported elastically with the spindle so as to follow the same relative displacements caused by the vibrations to which a textile spindle is normally subjected during operation.

More specifically the casing 15 of the motor, which houses the stator winding 16, has an upper flange 17 with a central hole 24 for the support cartridge to pass through the flange 17 which is turned inwards and provided with a plurality of radial holes 18 in each of which a fastening member in the form of a threaded pin 19 is screwed. In this way the casing 15 of the motor may be simply slid onto the projecting cylindrical part of the cartridge 6 and locked firmly to the latter by means of the threaded pins 19.

Likewise the rotor 20 of the motor is fastened removably to the shaft 1' consisting of the lower axial extension of the spindle 1; this fastening step is achieved by means of an expansion joint or locking device 21, or by means of any other locking device suitable for restraining mechanically the rotor 20 to the shaft 1' and at the same time for allowing it to be removed easily. In the case shown, the expansion joint or locking system comprises two conical rings 21 which are brought together axially by means of screws 22. The rings 21 adhere through pressure to the shaft 1' and to the internal surface of a cylindrical hole through the rotor 20. A removable cover 23 closes the casing 15 of the motor below. From what has been said and shown in the accompanying drawings, it is therefore clear that a motor-driven spindle for textile machines is provided, in which the spindle is held by an elastic system acting radially, and in which the spindle is driven to rotate by means of an electric motor which can be easily fastened and removed, simply by loosening the threaded pins 19 and the screws 22, and which at the same time allows the whole spindle with its cartridge to be slid out or removed according to what has been referred to previously.

The fact that the motor casing is fastened directly to the spindle support cartridge 6, in addition to the advantage of allowing easy removal and/or replacement of the spindle itself, allows the entire motor assembly 5 to follow the oscillations of the spindle, thus achieving a stable arrangement between rotor 20 and stator winding 16 even when the spindle vibrates, thereby preventing the two parts from coming into contact and damaging each other.

The proposed solution is extremely practical and advantageous since it not only allows easy removal of the spindle and the advantages previously disclosed but also enables oscillating, air-cooled supports to be used. This advantage would be impossible with any other arrangement or system for fastening the electric motor. Obviously what has been said and shown in the accompanying drawings has been given purely as an illustration of a preferred embodiment of the invention claimed.

What is claimed is:

1. A spindle driving and supporting device for a textile machine, comprising:

a frame (3) of the textile machine;

a rotatable spindle (1) arranged in the frame (3);

a cartridge means (6) for supporting the spindle (1) rotatably;

a hollow body (7) surrounding part of the cartridge means (6) and being secured to the frame (1);

elastic support means (8, 14), arranged peripherally around the cartridge means (6) and also arranged inside the hollow body (7), for acting radially to space the cartridge means (6) from the hollow body (7);

said rotatable spindle (1) having a shaft (1') extending axially through and beyond the cartridge means (6) and the hollow body (7);

electric motor means (5), fastened removably to a part of the cartridge means (6) extending axially beyond the hollow body (7), for driving the rotatable spindle (1);

said electric motor means (5) including a rotor (20) and a stator winding (16);

a casing means (15) for housing the electric motor means (5); and disengageable fastening means (21, 22), provided between the rotor (20) and the one end of the shaft (1') of the rotatable spindle (1) beyond the cartridge means (6) inside the casing means (15), for allowing removal of the rotor (20) from the one end of the shaft (1') of the rotatable spindle (1);

wherein said elastic support means (8, 14) are upper and lower pads (8, 14), including lower circular segments (14) made of an elastomeric material, placed inside the hollow body (7), and in which internal surfaces of the upper pads (8) have longitudinal recesses (11) leading into a cooling air circulation path (13) between the cartridge means (6) and the hollow body (7).

2. A device as recited in claim 1, in which said casing means (15) has an upper flange (17) at one end of the electric motor means (5), said flange (17) having a central hole (24) for the cartridge means (6) to pass through and also having a plurality of radial bore means (18) for allowing threaded pins (19) to be screwed against the cartridge means (6).

3. A device as recited in claim 2, in which said disengageable fastening means (21, 22) includes one of an expansion joint (21) and a locking device (21) at another end of the casing means (15).

4. A device as recited in claim 3, further comprising:

a removable lower cover means (23) for closing the casing means (15) at the other end thereof.

5. A device as recited in claim 1, in which the circulation path (13) of cooling air includes an annular chamber (13) between the cartridge means (6) and the hollow body (7), said annular chamber (13) opening outwardly through longitudinal recesses (11) in the upper pads 8) and also through radial holes (13') in the hollow body (7).

6. A device as recited in claim 1, in which the rotor (20) is fastened removably to the shaft (1') and the stator winding (16) is housed securely against an internal wall of the casing means (15), but is spaced from the rotor (20), so that the rotor (20) and the stator winding (16) are prevented from coming into contact and damaging each other.

* * * * *